US008641559B2

(12) United States Patent
Alan

(10) Patent No.: US 8,641,559 B2
(45) Date of Patent: Feb. 4, 2014

(54) GOLF BALL WITH ADJUSTABLE TACKINESS

(75) Inventor: Mark Alan, Portland, OR (US)

(73) Assignee: Nike, Inc., Beaverton, OR (US)

( * ) Notice: Subject to any disclaimer, the term of this patent is extended or adjusted under 35 U.S.C. 154(b) by 494 days.

(21) Appl. No.: 13/045,844

(22) Filed: Mar. 11, 2011

(65) Prior Publication Data

US 2012/0231899 A1 Sep. 13, 2012

(51) Int. Cl.
*A63B 37/12* (2006.01)

(52) U.S. Cl.
USPC ..... 473/378; 473/365; 427/208.8; 427/385.5

(58) Field of Classification Search
None
See application file for complete search history.

(56) References Cited

U.S. PATENT DOCUMENTS

| | | | | |
|---|---|---|---|---|
| 2,752,256 | A | 6/1956 | Hargis | |
| 3,682,690 | A | 8/1972 | Amos et al. | |
| 3,972,528 | A * | 8/1976 | McCracken et al. | 473/566 |
| 4,073,983 | A | 2/1978 | Van Cleave | |
| 4,192,766 | A | 3/1980 | Van Cleave | |
| 4,960,116 | A | 10/1990 | Milner | |
| 5,281,288 | A | 1/1994 | Murray et al. | |
| 5,409,233 | A | 4/1995 | Kennedy | |
| 5,429,703 | A | 7/1995 | Hartman et al. | |
| 5,664,774 | A | 9/1997 | Walker et al. | |
| 5,823,891 | A | 10/1998 | Winskowicz | |
| 5,938,544 | A | 8/1999 | Winskowicz | |
| 6,277,037 | B1 | 8/2001 | Winskowicz et al. | |
| 6,358,160 | B1 | 3/2002 | Winskowicz | |
| 6,371,869 | B1 * | 4/2002 | Kato et al. | 473/365 |
| 6,441,095 | B1 | 8/2002 | Keller et al. | |
| 6,558,270 | B2 | 5/2003 | Kwitek | |
| 6,623,382 | B2 | 9/2003 | Winskowicz | |
| 6,780,127 | B2 | 8/2004 | Kennedy, III | |
| 6,843,732 | B1 | 1/2005 | Huang | |
| 6,857,971 | B2 | 2/2005 | Huang | |
| 6,878,076 | B2 | 4/2005 | Winskowicz | |
| 6,936,205 | B2 | 8/2005 | Cavallaro et al. | |
| 6,974,392 | B2 | 12/2005 | Chang | |
| 6,986,719 | B2 | 1/2006 | Kennedy, III | |
| 7,070,518 | B2 | 7/2006 | Kennedy, III | |
| 7,186,189 | B2 | 3/2007 | Huang | |
| 7,214,145 | B2 | 5/2007 | Park et al. | |
| 7,226,961 | B2 | 6/2007 | Park et al. | |
| 7,638,580 | B2 | 12/2009 | Sasaki | |
| 2001/0014632 | A1 * | 8/2001 | Iwami et al. | 473/378 |
| 2001/0031670 | A1 * | 10/2001 | Iwami et al. | 473/371 |
| 2001/0041631 | A1 * | 11/2001 | Kato et al. | 473/363 |
| 2003/0170308 | A1 | 9/2003 | Cleary et al. | |
| 2003/0232666 | A1 | 12/2003 | Sullivan | |
| 2005/0227789 | A1 | 10/2005 | Winskowicz et al. | |
| 2006/0079645 | A1 | 4/2006 | Hasegawa et al. | |
| 2006/0194647 | A1 | 8/2006 | Winskowicz | |
| 2008/0280699 | A1 | 11/2008 | Jarvholm | |
| 2009/0105860 | A1 | 4/2009 | Wiesel | |

OTHER PUBLICATIONS

International Search Report and Written Opinion in PCT Application No. PCT/US2012/028428, mailed on Dec. 17, 2012.

* cited by examiner

*Primary Examiner* — Gene Kim
*Assistant Examiner* — John E Simms, Jr
(74) *Attorney, Agent, or Firm* — Quinn Law Group, PLLC

(57) ABSTRACT

A golf ball is provided that includes a coating. The coating is designed to allow a golfer to modify or increase the tackiness of the coating. The coating changes tackiness when exposed to a soaking material. A method of determining a desirable length of soak is also disclosed.

7 Claims, 6 Drawing Sheets

GOLF BALL WITH ADJUSTABLE TACKINESS

FIELD

The present application relates generally to golf balls. More specifically, the application relates to golf balls that include a coating that the user can modify to change the tackiness of the ball.

BACKGROUND

Golf balls typically have an outer coating or top layer made of polyurethane. Commonly, this outer coating is made of SURLYN or a similar material. This type of material may be selected for a number of reasons, including elastomeric qualities that allow the ball to deform when it is struck by a club.

Golf balls as typically constructed usually cannot be modified by the user to change their properties. In some cases, the lack of modifiability is due to a desire to prevent the user from changing the ball's properties in such a way that they no longer conform to USGA regulations. However, in other cases, it may be desirable to allow a user to modify the properties of the golf ball to enhance play, particularly when the ball is not being used in a competitive environment.

Among the obstacles that are faced by golfers is moisture on the course. Often the moisture takes the form of dew or rain on the grass and rain or other precipitation falling from the sky. This moisture can wet the ball and the club face. When there is moisture between the ball and club, the ball is likely to slip while in contact with the club more than when golfing in a dry situation. This slipping may cause the ball to have reduced spin after impact and may otherwise negatively affect the flight path of the ball.

In addition, other changes to a golfer's clubs may affect the degree of slip between the ball and the club. For example, if a new set of clubs is used, the surface of a new club face may have a reduced friction because it has not been used heavily and become abraded. Further, if a golfer begins to use a club with a different groove profile, the coefficient of friction of the club face may be reduced.

When these types of changes occur, it can cause a golfer to become flustered and mishit the ball to an even greater degree than caused by the equipment or conditions. Minimizing these effects may be helpful in the golfer having a pleasant golfing experience.

Accordingly, it may be desirable to provide a ball where the user can adjust the tackiness depending on the equipment and weather conditions. It may also be desirable for the tackiness to be varied depending on the golfer's expectations of the day on which golf will be played.

SUMMARY

In one aspect, a structure capable of being attached to another object is disclosed. The structure includes a coating layer, a substrate, and a securing structure. The coating layer is capable of changing in tackiness when exposed to a soaking material. The substrate has a first side adjacent the coating layer. The securing structure is on the second side of the substrate and is capable of securing the substrate to another object.

In another aspect, a golf ball includes a core and a cover radially outwardly of the core. A coating is radially outwardly of the cover and at least partially surrounds the cover. The coating is capable of changing tackiness when exposed to a soaking material.

In another aspect, a method of modifying the tackiness of a golf ball is disclosed. A golf ball is provided. The golf ball has an outer coating that is capable of changing in tackiness. The desired level of tackiness is determined. The length of time the golf ball must be exposed to a soaking material to achieve the desired level of tackiness is determined. The golf ball is exposed to the soaking material for the determined length of time.

In any of the embodiments, the soaking material may be a fluid. The fluid may be water. The soaking material may be microwaves, in which case, the ball may further include a shield layer capable of shielding at least the core from the microwaves.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The present embodiments relate generally to a golf ball that includes an outer coating that is capable of changing in tackiness. When a golfer determines that he or she wishes to change the tackiness of his or her ball on temporary basis, he or she may use the structures and methods disclosed herein to modify the ball's tackiness as he or she wishes.

Figure 1:
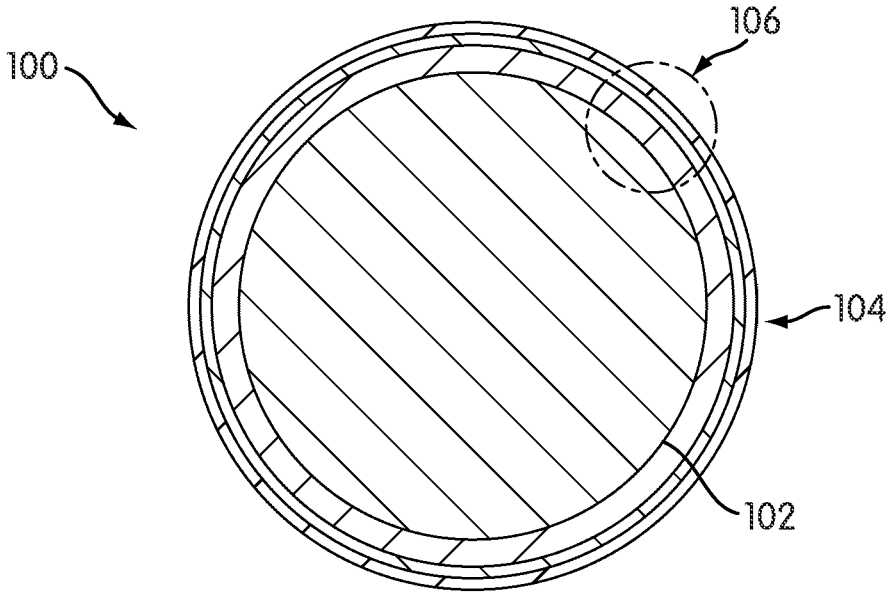
FIG. 1 is a cross sectional view of an embodiment of a golf ball.
Figure 2:
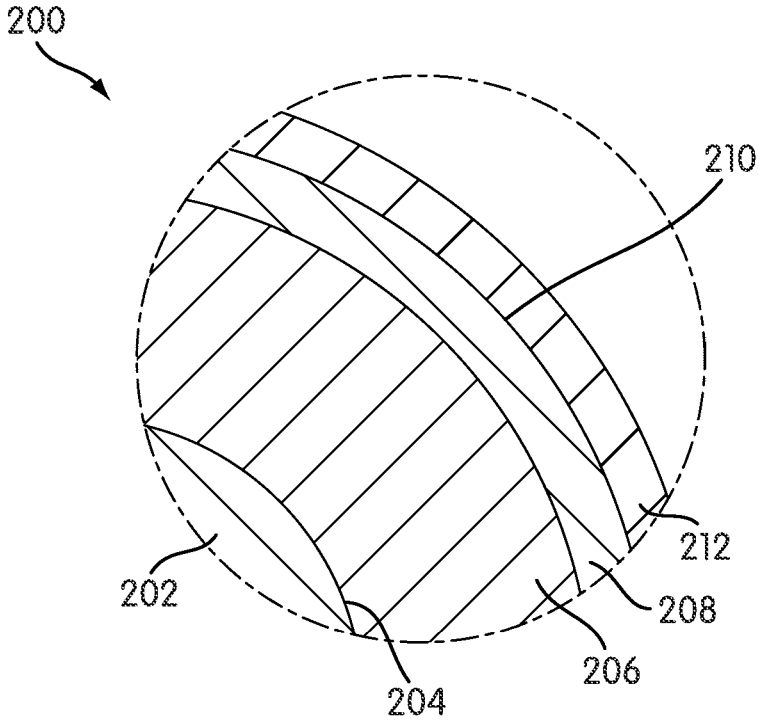
FIG. 2 is a detailed view of one embodiment of a golf ball.
Figure 3:
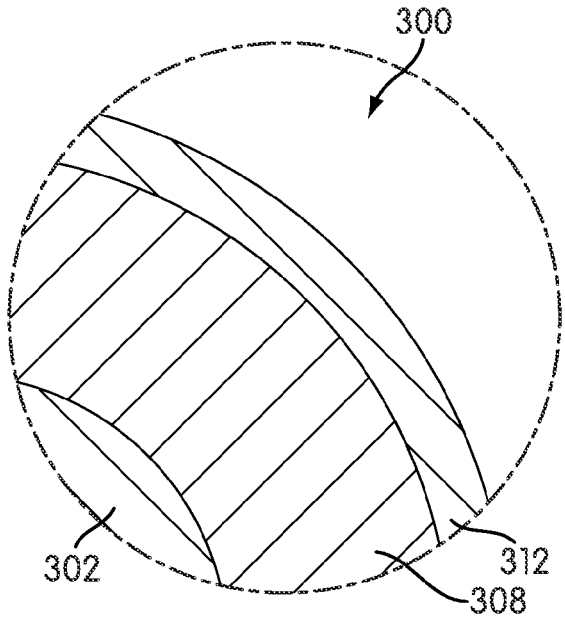
FIG. 3 is a detailed view of another embodiment of a golf ball.
Figure 4:
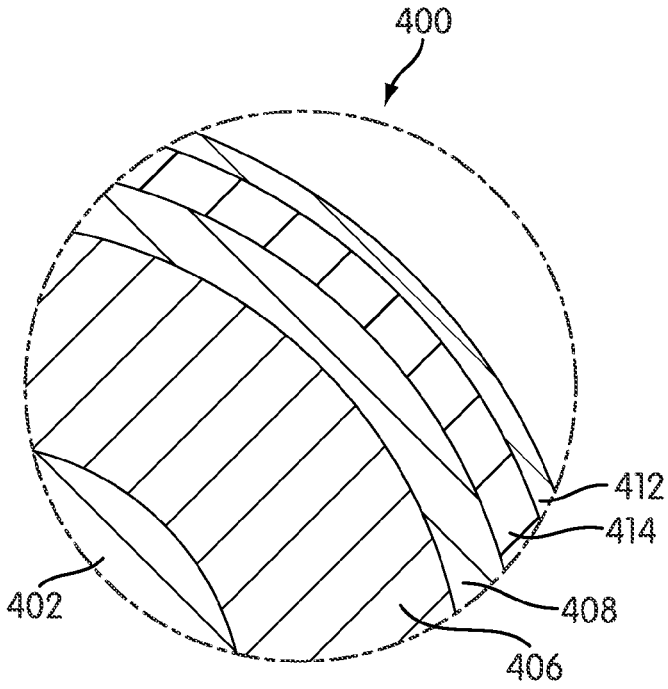
FIG. 4 is a detailed view of another embodiment of a golf ball.

FIG. 1 is a cross-sectional view of one embodiment of golf ball 100. In the embodiment of FIG. 1, ball 100 includes core 102 and a plurality of additional layers, identified generally as layers 104. The embodiments shown FIGS. 2-4 are possible series of external layers 104 that are radially outwardly of and at least partially surround core 102. The dashed circle corresponds to the detailed views of FIGS. 2-4.

FIG. 2 shows a series of radially positioned layers. Each layer is shaped generally as a sphere having a radius. While each layer need not be perfectly spherical, it is desirable if ball 200 is substantially spherical, which typically is achieved by superposing various spherical layers around each other. The innermost layer is core 202. Core 202 is generally spherical and each point on the exterior surface 204 of core 202 has a radius that reaches from the center of ball 200 to that corresponding point. Core 202 may be selected from any conventional material from a core of a golf ball, including, but not limited to a rubber or thermoplastic elastomer. Core 202 may also be liquid, if desired.

Medial layer 206 may be radially outwardly of core 202 and may at least partially surround core 202. It may be desirable for medial layer 206 to completely surround core 202. Medial layer 206 may be any conventional medial layer in a golf ball. For example, medial layer 206 may be a wound layer in some embodiments. Alternatively, medial layer 206 may be an optional mantle layer in other embodiments.

Cover 208 may be radially outward of medial layer 206 and may at least partially surround medial layer 206. It may be desirable for cover 208 to completely surround medial layer 206. Cover 208 may be made from any sort of conventional material. For example, cover 208 may be made from balata, an elastomer, such as polyurethane, or SURLYN®. Cover 208 may be conventionally formed and molded. In such an instance, cover 208 will include outer surface 210 that includes the various features commonly found on an outer surface of a golf ball. For example, outer surface 210 may include a pattern of dimples and lands surrounding the dimples. Further, outer surface 210 may be imprinted with such items as a logo, trademark, monogram, compression, or any other colorings or markings as are commonly found on the outer surface of a ball. The FIGS. have been simplified to show a spherical outer surface 210, as the selection of a particular dimple pattern, imprint, or the like is not critical to these embodiments.

The layers of ball 200 that have been described may be manufactured in a conventional manner. Ball 200 may, in fact, be selected from one of the three-part balls currently commercially available from such manufacturers as Nike, Inc. The interior layers, including core 202, medial layer 206, and cover 208 are illustrated in FIG. 2 as having particular thicknesses. These thicknesses can be modified by persons having skill in the art based on the desired ball characteristics and the materials desired to be used. The interior layers need not have the thicknesses illustrated in this or other FIGS.

Coating 212 is radially outwardly of cover 208. Coating 212 may at least partially surround cover 208 and in some embodiments may completely surround cover 208. Coating 212 may be applied to cover 208 in any manner that is appropriate for coating 212.

Coating 212 may be one of various materials that are capable of changing properties after being exposed to a soaking material. In many cases, coating 212 may be made from a material that is capable of changing in tackiness. Coating 212 may have a first tackiness at a first time and a second tackiness after being exposed to a soaking material. Coating 212 and the soaking material must be considered together. Not every possible coating can be soaked in every possible soaking material to change tackiness.

One material that may be useful in the present embodiments is a hydrophilic material. A hydrophilic material may be an aliphatic, polyether-based thermoplastic polyurethane that may have a hardness between 90 Shore A and 60 Shore D. Hydrophilic materials may absorb water content. Hydrophilic gels may be hydrogels that can absorb equilibrium water contents between about 500% and about 2000% of the weight of dry resin. The hydrophilic gel may be added to the ball as a top layer through injection molding or extrusion.

In many embodiments, it is desired that the soaking material increase the tackiness of the coating when the coating is exposed to the soaking material. The use of such a coating that increases in tackiness is desirable, as an untreated ball and club combination ordinarily decreases in tackiness when exposed to wet conditions. There is typically little need to further reduce the friction between the ball and the club in many embodiments. Accordingly, while it is possible that a material would be selected to further reduce friction, it would be used only in specific situations where a reduced friction is desired.

In one embodiment, coating 212 can be polyurethane based. In another example, coating 212 may use a natural or synthetic rubber, such as neoprene, as a base. To the base may be added a tackifier, such as rosin. In other embodiments, the tackifier may take the form of petrolatum or polybutene, which, alone or in combination, provide increased tack when wet without the inclusion of an adhesive material.

When a hydrophilic material, such as those mentioned above, are used, the tackiness of coating 212 can be modified by soaking ball 200 in a water as a soaking material. In some embodiments, the tackiness of coating 212 when coating 212 is completely dry is a first tackiness. When ball 200 is soaked in the soaking material, coating 212 increases in tackiness to a second tackiness. The second tackiness is greater than the first tackiness. The longer ball 200 is soaked in the soaking material, the greater the increase in tackiness, up to a maximum available to the material. In some embodiments, a second, protective coating may be applied radially outwardly of and at least partially surrounding coating 212. This protective coating may restrict the contact between coating 212 and the soaking material to yield a different soak time for increased tackiness In other embodiments, a different type of fluid may be used as the soaking material to change the tackiness of coating 212. In some embodiments a different solvent, such as acetone, may function as a soaking material. In other embodiments, salt water or water at an increased temperature may function as a soaking material. In other embodiments, heat or cold may function as a soaking material. Different coating materials 212 are likely to be necessary for different desired soaking materials.

As noted earlier, some of the layers of the ball may be eliminated. FIG. 3 shows the use of a standard two-piece ball 300. Ball 300 includes core 302. Core 302 may be selected from any conventional material from a core of a golf ball, including, but not limited to a rubber or thermoplastic elastomer. Core 302 has the same general properties as described earlier in connection with core 202 of FIG. 2. Cover 308 is radially outward of core 302 and at least partially covers core 302. In some embodiments, cover 308 may completely cover core 302. Cover 308 has the same general properties as described earlier in connection with cover 208 of FIG. 2.

Surrounding cover 308 is coating 312. Coating 312 is made from a material that has a first tackiness at a first time and a second tackiness at a second time after being exposed to a soaking material. Coating 312 is radially outwardly of cover 308. Coating 312 may at least partially surround cover 308 and in some embodiments may completely surround cover 308. Coating 312 may be applied to cover 308 in any manner that is appropriate for coating 312 and cover 308. Coating 312 may have the properties as described above in connection with coating 212 in FIG. 2.

Another embodiment is shown in FIG. 4. FIG. 4 shows ball 400 that includes core 402. Core 402 may be selected from any conventional material from a core of a golf ball, including, but not limited to a rubber or thermoplastic elastomer. Core 402 has the same general properties as described earlier in connection with core 202 of FIG. 2 and core 302 of FIG. 3.

Medial layer 406 may be radially outwardly of core 402 and may at least partially surround core 402. Medial layer has the same general properties as described earlier in connection with medial layer 206 of FIG. 2. As was disclosed in connection with FIG. 3, medial layer 406 is optional, and a person having ordinary skill in the art is able to determine what sort of ball should be used in connection with the embodiments disclosed.

Cover 408 may be radially outward of medial layer 406 and may at least partially surround medial layer 406. It may be desirable for cover 408 to completely surround medial layer 406. Cover 408 may be made from any sort of conventional material. Cover 408 may have the properties as described above in connection with cover 208 in FIG. 2 and cover 308 in FIG. 3.

Shield layer 414 may be radially outward of cover 408 and may at least partially surround cover 408. In some embodiments, shield layer 414 may completely surround cover 408. Coating 412 may be radially outward of shield layer 414 and may at least partially surround shield layer 414. In some embodiments, coating 412 may completely surround shield layer 414. Coating 412 may have the properties as described above in connection with coating 212 of FIG. 2 and coating 312 of FIG. 3.

The materials for coating 412 and shield layer 414 may be selected in combination. In some embodiments, it may be desired to use a coating that changes in tackiness when exposed to a soaking material that may harm the remainder of the ball. In some embodiments, coating 412 may be selected to change in tackiness when exposed to microwave radiation, such as is typically available in a golfer's microwave oven. Exposing the remainder of ball 400 may be undesirable, as the microwave radiation may cause various parts of ball 400 to melt or deform. Such a change in ball 400 may be undesirable for many such balls 400. Accordingly, if, for example, the soaking material that changes the tackiness of coating 412 is microwave radiation, shielding material 414 may be a metal film that would shield the rest of ball 400 from the radiation. In some embodiments, with some soaking materials, it may be desirable for shielding material 414 to completely shield the rest of ball 400 from the soaking material. In other cases, it may only be necessary to substantially, or even partially, shield the rest of ball 400. The choice of shielding material, thickness, and coverage for the shielding layer 414 will, therefore, be dependent on the choice of material for coating 412.

In some embodiments, shielding layer 414 may be placed radially outwardly of cover 408. Placing shielding layer 414 radially outwardly of cover 408 permits shielding layer 414 and coating 412 to be applied to any conventional ball 400. However, in other embodiments, shielding layer 414 can be embedded in ball 400 between cover 408 and core 402. Inclusion of shielding layer 414 during manufacture may allow less material to be used to create shielding layer 414 if only a portion of ball 400, such as only core 402, needs to be shielded from a particular soaking material.

Figure 5:
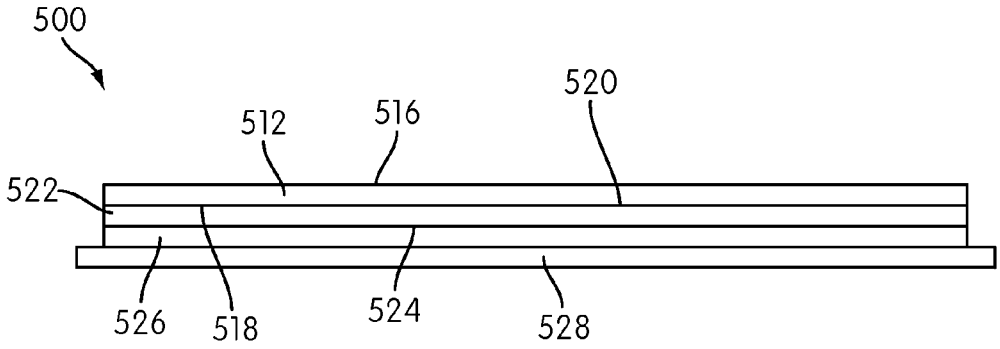
FIG. 5 is a side view of a series of layers that may be applied to a golf ball.

FIG. 5 is a side view of a structure that may be used to apply a coating onto a ball or other object. In some embodiments, it may be desirable to apply the coating to a ball when the coating is in a liquid state. However, in some instances, and for some desired soak materials, using a liquefied coating may be less desirable than using a solid coating. A solid state system may be easier for an end user to apply without purchasing complicated equipment or performing multiple steps to apply the structure to a ball. If using a solid coating is desired, a structure such as that in FIG. 5 may be used.

FIG. 5 shows a multi-layer system. On one side of the coating application structure 500 is coating layer 512. Coating layer 512 is made of a material that is capable of changing and increasing in tackiness when exposed to a soaking material. Coating material 512 has the same general characteristics and properties as coating layer 212 in FIG. 2, 312 in FIGS. 3, and 412 in FIG. 4. A first side 516 of coating layer 512 is exposed. A second side 518 of coating material 512 is placed a first side 520 of adjacent substrate 522. Substrate 522 may be a shielding layer or material having properties generally the same as shield layer 414 of FIG. 4. For example, in an embodiment where coating 512 changes tackiness when exposed to microwaves, substrate 522 may be a metal film. However, substrate 522 need not have shielding properties in every instance. In some embodiments, substrate 522 may simply be a substrate to allow for ease of manufacturing of the layered structure 500. In other embodiments, substrate 522 may form a UV shield. In other embodiments, substrate 522 may be eliminated altogether.

On second side 524 of substrate 522 is a securing structure 526. Securing structure 526 can be any structure that is appropriate for securing the remainder of the layered structure 500 to a ball or other object (not shown). In some embodiments, securing structure 526 may be an adhesive. In some embodiments, securing structure 526 may be a pressure sensitive adhesive. In other instances, securing structure 526 could be a hook and eye fastening system. In other instances, securing structure 526 may be omitted if substrate 522 is made of a material capable of being used in a "shrink wrapping" style attachment system. In such an instance, pressing second side 524 against the cover of the ball and heating the assembly, as in boiling water or hot air or via other application of heat, would secure the layered structure 500 to the ball. If securing structure 526 is an adhesive, an optional release paper 528 may be pressed onto the adhesive to prevent premature sticking.

If a golfer determines that he or she wishes to change the tackiness of his or her ball, various steps are necessary. First, the golfer must have a ball that has been modified in accordance with one of the embodiments disclosed herein. The golfer must then determine the amount of tackiness increase the golfer wishes and a corresponding necessary length of time the ball must be exposed to the soaking material to achieve the desired or determined level of tackiness. These determinations can be performed in a number of ways.

Figure 6:
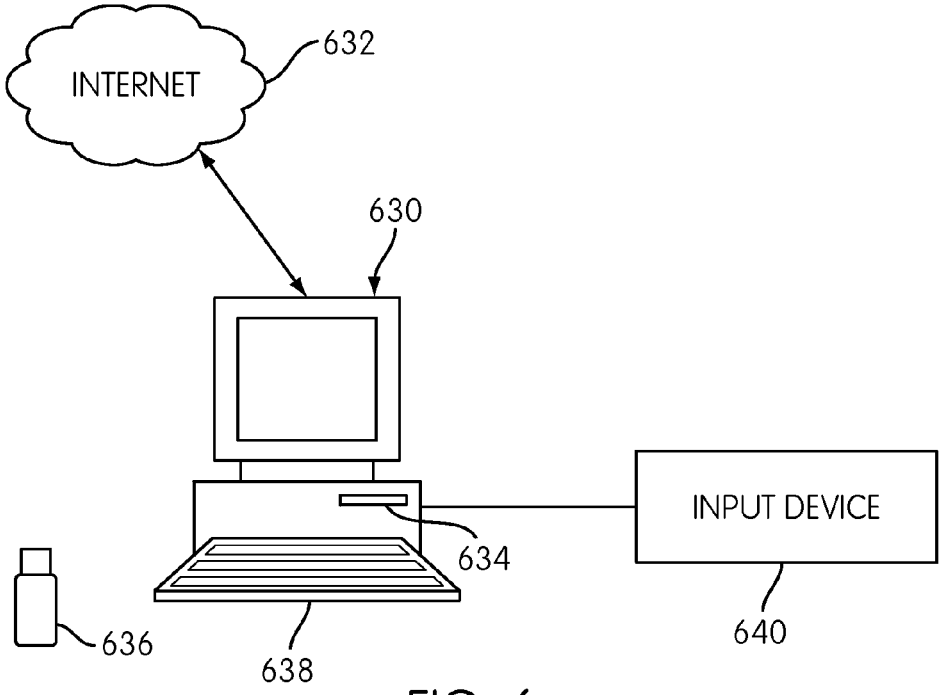
FIG. 6 is a schematic view of one embodiment of determining the length of soak time.

A first way of making such determinations is illustrated in FIG. 6. FIG. 6 illustrates computer 630 that may be connected to the internet 632. Computer 630 may have access to software or another calculation system that may be available on the hard drive of computer 630 or may be accessible by the computer through internet 632, a floppy disc, CD, DVD, or other media readable in drive 634, or another external storage medium. Another storage medium illustrated is USB drive 636, but other storage media, such as external floppy or hard drives are also possible locations for the storage of the software. Any of these accessories or others associated with the computer may be linked with the computer through any wired or wireless connections commonly available in the industry.

Once the computer 630 accesses the software, the user can make a determination of what level of increased tackiness is desired. The software may be equipped with information that is available for the user to read or other forms that may guide the user in determining what increased level of tackiness is desired. Alternatively, the software may simply allow a user to select a level of tackiness without offering any sort of guidance. The user may input the desired level of increase with any sort of input device. For example, the user could input data with keyboard 638 or another input device 640. Examples of alternative input devices include a mouse, stylus, touch pad, or other input devices available in the industry. These input devices may be linked with computer 630 by any wired or wireless connection available in the industry.

Once the user has selected a desired level of tackiness, the computer may access the software and calculate the necessary soak time to achieve the desired tackiness level. The software may use an algorithm to make that determination or may instead use a lookup table to correlate the tackiness level with the soak time. The software may output a result which advises the user of the appropriate soak time.

In order to make such determinations as discussed above, the user may have to make other inputs. For example, in some embodiments, the user may need to input items relating to the ball itself, such as a model number of a golf ball or a desired soaking material. In some embodiments, the user may also need to input environmental data, such as the predicted humidity or temperature at the time the ball is predicted to be used. Any of these items may be input using the same structures as described above.

Figure 7:
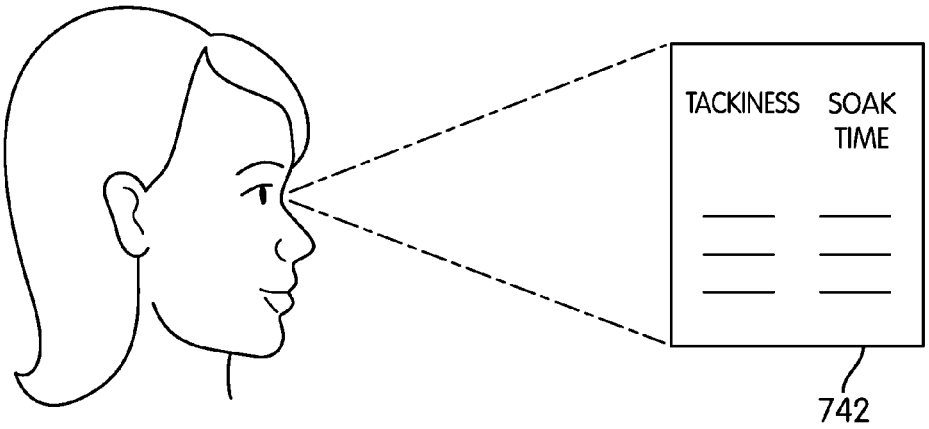
FIG. 7 is a schematic view showing another embodiment of determining the length of soak time.

An alternative form of making these determinations may be seen in FIG. 7. FIG. 7 shows the use of a card or chart 742 that a user can see. In some embodiments, chart or table 742 may relate the desired tackiness to a soak time. Table 742 may also offer guidance to the user regarding what level of tackiness may be desirable in different circumstances. In addition, chart 742 may be integrated with computer 630 shown in FIG. 6. In some cases, computer 630 may be able to access a non-interactive style chart, such as the chart 742 and merely display it for the user to see to make an appropriate determination. Regardless of the form in which it is seen or distributed, such a chart may be used in both determining steps.

Figure 8:
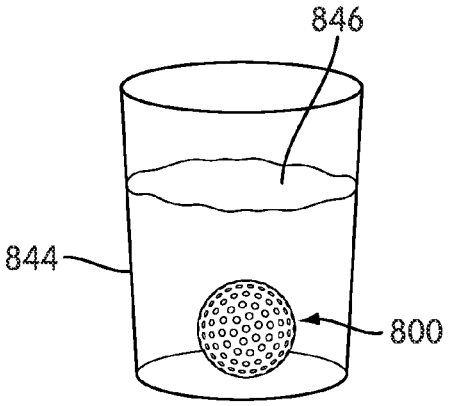
FIG. 8 is a schematic view showing one embodiment of a soak method.

Once the length of time for soak is determined, the user must expose the ball to the soaking material. FIG. 8 shows an exemplary ball 800. Ball 800 may be any of the embodiments discussed above which includes a coating that allows the tackiness of the coating to change when it is exposed to a fluid, such as fluid 846. Fluid 846 may be desirably housed in container 844, which may be any appropriate shape and size. FIG. 8 shows ball 800 fully submerged in fluid 846, but in some embodiments, it may only be necessary for ball 800 to be at least partially submerged in fluid 846. Fluid 846 used in such an embodiment may be selected based on the material used for the coating. The fluid and coating may correspond so that the coating can change in tackiness to the desired tackiness level. Once the soak time has elapsed, the user can then remove ball 800 from fluid 846 and proceed to use ball 800.

Figure 9:
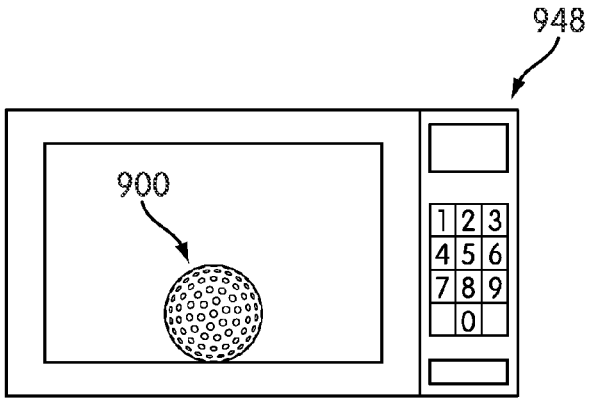
FIG. 9 is a schematic view showing another embodiment of a soak method.

In another embodiment, FIG. 9 shows an exemplary ball 900. Ball 900 may be any of the embodiments discussed above which includes a coating that allows the tackiness of the coating to change when it is exposed to microwave radiation. Ball 900 may then be placed in microwave 948. Microwave 948 can then be activated at a power level and for a length of time so the coating on ball 900 can change in tackiness to the desired tackiness level. Once the soak time has elapsed, the user can then remove ball 900 from microwave 948 and proceed to use ball 900.

In some embodiments, the coating may be selected such that the change in tackiness is permanent. In other embodiments, the coating may be selected such that the change in tackiness is temporary. For example, in some embodiments, some coatings may allow a change in tackiness after they have been soaked in water. When the water evaporates from the coating, however, the coating may return to its initial level of tackiness. If the coating is selected so that the tackiness change is permanent, the user may select different soak times for different balls to allow a series of balls with different tackiness levels. In other embodiments, a drying step may be used, if desired, to remove water and change the tackiness level.

Figure 10:
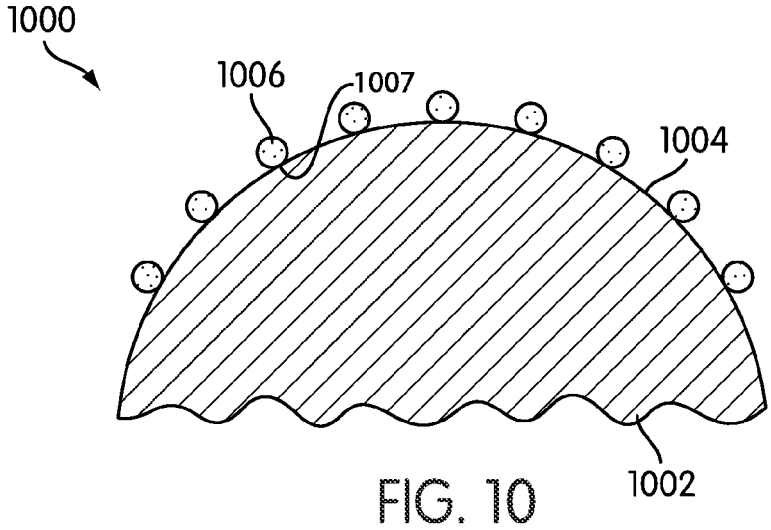
FIG. 10 is a partial cross section of one embodiment of a ball showing a series of particles on a core layer.
Figure 11:
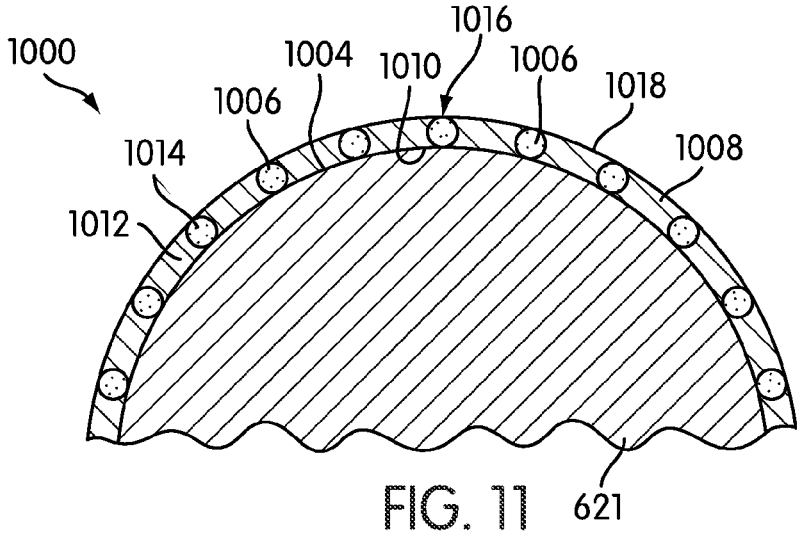
FIG. 11 is a partial cross section of the ball of FIG. 10 with a cover layer applied thereto.
Figure 12:
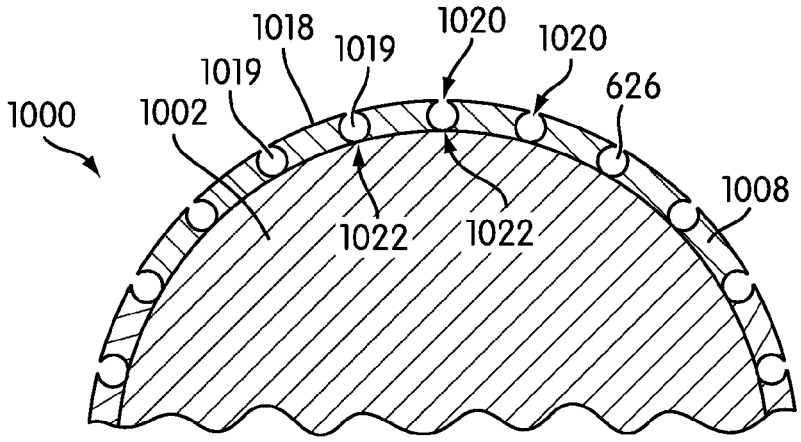
FIG. 12 is a partial cross section of the ball of FIG. 11 after the particles have been removed.
Figure 13:
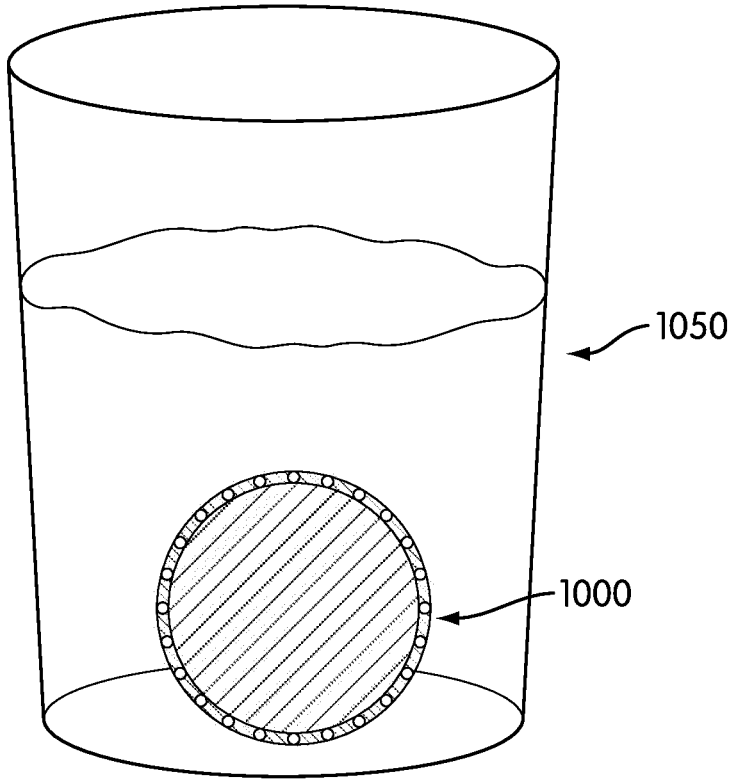
FIG. 13 is a schematic view, the ball of FIG. 12 being shown in cross section, of an embodiment of a soak method.
Figure 14:
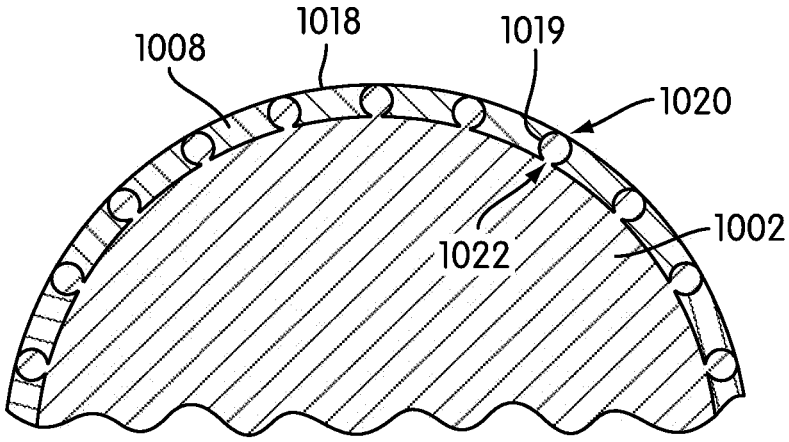
FIG. 14 is a partial cross section of the ball of FIG. 12 after it has been subjected to the soak method of FIG. 13.

Another embodiment of a structure that may be used to adjust the tackiness of a ball is shown in FIGS. 10-14. FIGS. 10-12 show a method of making an alternative embodiment, FIG. 13 shows an embodiment of a soaking method, and FIG. 14 shows the ball of FIG. 12 after it has been exposed to the soaking material. A difference between the embodiment shown in FIGS. 10-14 and the embodiments shown in earlier FIGS. is the placement of the layer that has an adjustable tackiness or causes a change in the effective tackiness of the ball. In the previously described embodiments, the layer with adjustable tackiness was desirably applied to an outer surface of a cover of a ball. In the embodiment of FIGS. 10-14, the layer with adjustable tackiness instead may be placed inward of the cover.

The embodiment of FIGS. 10-14 is shown in simplified form. Turning first to FIG. 10, ball 1000 may include a core layer 1002. Core layer 1002 is shown in partial cross-section. Core layer 1002 is shown in simplified form and is shown as if core layer 1002 is the only core layer in ball 1000. In some embodiments, core layer 1002 may be the only core layer. In other embodiments, the core of ball 1000 may be made of multiple layers. If the core is made of multiple layers, core layer 1002 may desirably be the outermost core layer 1002, but in some embodiments, core layer 1002 may be inward of an outermost layer.

Core layer 1002 may be made of a material that is capable of absorbing a designated soaking material. In many embodiments, the designated soaking material may desirably be water. In the present disclosure, a hydrophilic material is capable of absorbing water. A person having ordinary skill in the art will be able to select desirable materials that create an effect equivalent to the hydrophilic material and water as described herein. In some embodiments, core layer 1002 may include a superabsorbent polymer.

On an outer surface 1004 of core layer 1002 is positioned a plurality of particles 1006. Particles 1006 may be applied to core layer 1002 by rolling core layer 1002 in a layer of particles 1006. Alternatively, particles 1006 may be sprayed onto core layer 1002. Any desirable method for applying particles 1006 to core layer 1002 may be used if deemed desirable by a person having ordinary skill in the art. While FIG. 10 shows particles 1006 as being spaced generally evenly over core layer 1002 and being about equal in shape and size, in some embodiments, particles 1006 may be distributed unevenly and may be of varying shapes and sizes. Particles 1006 may be made of a material that is soluble in a fluid. It is desirable that particles 1006 not be soluble in air and that particles 1006 not be soluble only in the material that affects core layer 1002, for reasons that will become apparent in the disclosure below. Each particle 1006 may define a region of contact 1007 between particle 1006 and core layer 1002.

After the application of particles 1006 to core layer 1002, cover or cover layer 1008 may be applied over core layer 1002 and particles 1006. The covering of core layer 1002 by cover layer 1008 may be done in any of a variety of conventional ways. It may be desirable in many embodiments to use an injection molding technique to apply cover layer 1008. Cover layer 1008 is shown as being a single layer and as the outermost layer in FIGS. 10-14. In some embodiments, cover layer 1008 may include a primary cover layer and a further layer that includes various indicia indicating a ball manufacturer, a brand name, or the like. Cover layer 1008 may also include a top coat for appearance or other reasons. In addition, cover layer 1008 may be molded to include various dimples and frets or lands. These designs are not shown in the FIGS., but an appropriate dimple pattern may be selected by a person having ordinary skill in the art. Cover layer 1008 may be applied to core layer 1002 so that an inner surface 1010 of cover layer 1010 touches outer surface 1004 of core layer 1010. This design may cooperate to place cover layer 1008 radially outwardly of and partially surrounding cover layer 1002.

It may be desirable in many embodiments to configure cover layer 1008 in conjunction with particles 1006. When cover layer 1008 is molded, the material forming cover layer 1008 may flow onto outer surface 1004 of core layer 1002 and may partially surround each particle 1006. It may be desirable to design cover layer 1008 so that the thickness 1012 of cover layer 1008 may be slightly lower than the diameter or effective thickness 1014 of an average particle 1006. In many embodiments, it is desirable that a portion, such as portion 1016 of each particle 1006 be exposed on an outer surface 1018 of ball 1000 at this intermediate stage. A person having ordinary skill in the art will be able to select appropriately sized particles and cover thickness depending on the particles desired to be used, the cover material desired to be used, the core materials desired to be used, durability requirements for the ball, and the like.

Once ball 1000 has reached this intermediate stage and all the layers have been set to a desired state, particles 1006 may be removed from ball 1000. The removal of particles 1006 may be done in a variety of ways. In some embodiments, the particles 1006 may be mechanically removed, such as by a drill or power washing. In some cases, there may be a plurality of drills or water washes that are specifically positioned at each particle location. However, in embodiments where particles 1006 are quite small or are irregularly positioned on ball 1000, the use of individual drills may be undesirable. In many embodiments, ball 1000 may instead be placed in a soak (not shown). While in the soak, the particles 1006 may be dissolved in the solvent in the soak. In some embodiments, the solvent may be water. In other embodiments, the solvent may be acetone. In other embodiments, the solvent could be a heat treatment that may melt the particles 1006 combined with a wash to remove any melted particle parts.

When this soaking step is concluded, ball 1000 may be configured as shown in FIG. 12. It may be desirable that the solvent selected in the soaking step be one that does not affect core layer 1002 or cover layer 1008, so that core layer 1002 and cover layer 1008 remain in the same configuration relative to one another.

At the end of the soaking step, there may be a plurality of recesses 1019 created in cover layer 1008. These recesses 1019 may correspond generally to the respective positions of the particles 1006 before the soak step. The recesses 1019 may also have access to the environment through apertures 1020 defined in outer surface 1018 of cover layer 1008 and to core layer 1002 by exposure regions 1022. Apertures 1020 defined in outer surface 1018 of cover layer 1008 may generally correspond in shape, size, and position to the portions 1016 of particles 1006 that remained exposed prior to the soak. The apertures 1020 may be created by the removal of particles 1006. The removal of particles 1006 may also expose core layer 1002 in an exposure region 1022. Each exposure region 1022 may correspond generally to a respective region of contact 1007 between particles 1006 and core layer 1002. The existence of at least one recess 1019 having an open aperture 1020 to the atmosphere and an open exposure region 1022 may allow materials placed outside core layer 1002 to come into contact with core layer 1002.

As shown in FIG. 13, ball 1000 then may be placed in a soak 1050. In FIG. 13, the soak 1050 is shown as being a glass of water. Because the soak 1050 may be used by an ordinary golfer in his or her home, it may be desirable to select a soak material that is easily accessible to an ordinary golfer. In some embodiments, the soak material may be water or another fluid of a particular temperature. In other embodiments, the soak material may be another material that a golfer may be likely to have in his or her home, such as an acid, for example, vinegar or tea. As described above, the soak material may be selected in conjunction with the material for core layer 1002. As noted earlier, core layer 1002 is hydrophilic, which means that it is designed to absorb the soak material and expand. In some embodiments, it may be desirable to calculate the amount of absorption core layer 1002 may undergo after exposure to the corresponding soak material and a chart, guide, or other key may be provided to the golfer either in the packaging, through an electronic interface, such as a mobile phone app or an internet web site, or through other direct means, such as a color change or the like on the ball once a desirable soak time has passed. Alternatively, it may be desirable instead to provide soak systems at golf courses where a golfer may simply insert his or her balls into a soak system at the course and the soak system will allow the balls to soak for the desired time frame and return the balls to the golfer. Such a system may desirably be used when the core material and the soak material need only be in contact with one another for a relatively brief period of time.

After ball 1000 is exposed in the soak 1050 for a desired period of time, ball 1000 may have the configuration shown in FIG. 14. In the soak, core layer 1002 may be exposed to the soak material through the soak material passing through each aperture 1020, passing into each recess 1019, and coming into contact with core layer 1002 at each exposure region 1022. This exposure of the hydrophilic material in core layer 1002 to the soak material may cause the hydrophilic material to absorb the soak material and expand. The hydrophilic material of core layer 1002 may expand by extending through each exposure region 1022, into each recess 1019 and finally reaching each aperture 1020. When the hydrophilic material 1020 reaches at least one aperture 1020, it is capable of changing the play characteristics of ball 1000.

In many embodiments, such as described herein, it may be desirable to select a hydrophilic material that has an increased tackiness relative to the remainder of outer surface 1018 of cover layer 1008. When a golfer is playing in inclement conditions, such as when it is raining, the golfer is likely to experience a conventional ball as having decreased tackiness, due to the presence of water between the conventional ball and the club. However, when the hydrophilic material projects into apertures 1020, the hydrophilic material increases the tackiness of outer surface 1018 of ball 1000. The use of such a ball may be sufficient to counteract the decrease in effective tackiness due to the presence of water and therefore, the golfer may not experience any difference in play due to tackiness.

In the present embodiments, ball 1000 may have a first effective tackiness before it is exposed to the soak 1050. Accordingly, ball 1000 may have a first effective tackiness in the configuration shown in FIG. 12. After ball 1000 is exposed to the soak 1050 in FIG. 13, it may have the configuration shown in FIG. 14. When ball 1000 has the configuration shown in FIG. 14, it may have a second effective tackiness. Second effective tackiness may be higher than first effective tackiness.

In some embodiments, it may be possible to vary the second effective tackiness. Because balls deform and compress upon contact with a golf club, the apertures may also deform and compress. Accordingly, in some embodiments, the hydrophilic layer may only need to partially fill one or more of the recesses in the cover layer to change the effective tackiness of the ball when it comes into contact with a golf club. In such an instance, it may be possible to calculate various soak times that produce various effective tackinesses, depending on the expansion rate of the hydrophilic material, the size and shape of the recesses and apertures, and the like.

The various embodiments shown and described herein may be designed to be used alone or in combination with one another. Where one of the embodiments describes a possible desirable configuration and the other does not, a person having ordinary skill in the art will be able to determine whether such a configuration may be used in conjunction with a different embodiment and will be able to make any necessary changes to modify the configuration without undue experimentation.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of changing tackiness of a golf ball, comprising;

providing a golf ball having a layer capable of changing in tackiness with exposure to a soaking material;

determining a level of tackiness desired;

determining a length of time the golf ball must be exposed to a soaking material to achieve the desired level of tackiness; and exposing the golf ball to the soaking material for the determined length of time; such that said golf ball has changed to the desired level of tackiness.

2. The method of changing the tackiness of a golf ball according to claim 1, wherein the exposing step comprises exposing the golf ball to a fluid.

3. The method of changing the tackiness of a golf ball according to claim 2, wherein the fluid is a liquid and the exposing step comprises at least partially submerging the golf ball in the liquid.

4. The method of changing the tackiness of a golf ball according to claim 3, wherein the liquid is water.

5. The method of changing the tackiness of a golf ball according to claim 1, wherein the step of determining the length of time comprises using a lookup table that correlates tackiness level with soak time.

6. The method of changing the tackiness of a golf ball according to claim 1, wherein the step of determining the level of tackiness desired comprises inputting data into a computer.

7. The method of changing the tackiness of a golf ball according to claim 1, wherein changing the tackiness of the outer coating comprises increasing the tackiness of the outer coating.

* * * * *